US008198971B2

(12) United States Patent
Takenaka et al.

(10) Patent No.: US 8,198,971 B2
(45) Date of Patent: Jun. 12, 2012

(54) LAMINATED INDUCTOR

(75) Inventors: Kazuhiko Takenaka, Nagano-ken (JP); Tsuyoshi Kawada, Shiga-ken (JP)

(73) Assignee: Murata Manufacturing Co., Ltd. (JP)

( * ) Notice: Subject to any disclaimer, the term of this patent is extended or adjusted under 35 U.S.C. 154(b) by 44 days.

(21) Appl. No.: 12/821,675

(22) Filed: Jun. 23, 2010

(65) Prior Publication Data

US 2011/0001599 A1 Jan. 6, 2011

(30) Foreign Application Priority Data

Jul. 6, 2009 (JP) ..... 2009-159863

(51) Int. Cl.
*H01F 5/00* (2006.01)
*H01F 27/30* (2006.01)
*H01F 27/28* (2006.01)

(52) U.S. Cl. ..... 336/200; 336/206; 336/222; 336/223; 336/232

(58) Field of Classification Search ..... 336/192, 336/200, 206, 222, 223, 232
See application file for complete search history.

(56) References Cited

U.S. PATENT DOCUMENTS

2008/0197963 A1* 8/2008 Muto ..... 336/200

FOREIGN PATENT DOCUMENTS

| | | | |
|---|---|---|---|
| JP | 11-265823 | A | 9/1999 |
| JP | 2002-260925 | A | 9/2002 |
| JP | 2006-042097 | A | 2/2006 |
| JP | 2006-066829 | A | 3/2006 |

OTHER PUBLICATIONS

English translation on JP2006066829A.*

* cited by examiner

*Primary Examiner* — Anh Mai
*Assistant Examiner* — Ronald Hinson
(74) *Attorney, Agent, or Firm* — Studebaker & Brackett PC; Tim L. Brackett, Jr.; John F. Guay

(57) ABSTRACT

A laminated inductor includes a laminate having a plurality of insulating layers, a helical coil and first and second external electrodes on an underside of the laminate. The helical coil has coiled electrodes, each coiled up in one turn, and the first and second external electrodes are connected to respective, or corresponding, ends of the helical coil. Each of the coiled electrodes of the helical coil follow a path along the periphery of one of the insulating layers and include first end located in the path and second end located outside the path. The helical coil and the first external electrode are connected to each other by a lead via conductor formed in a space that is enclosed by parts of the coiled electrodes including the first and second ends.

4 Claims, 4 Drawing Sheets

LAMINATED INDUCTOR

CROSS REFERENCE TO RELATED APPLICATIONS

The present application claims priority to Japanese Patent Application No. 2009-159863 filed Jul. 6, 2009, the entire contents of which is hereby incorporated herein by reference in their entirety.

BACKGROUND

1. Field of the Invention

The present invention relates to laminated inductors, and in particular, relates to laminated inductors having external electrodes formed on bottom surfaces of the laminate.

2. Description of the Related Art Japanese Unexamined Patent Application Publication (JP-A) No. 2002-260925, for example, describes a laminated inductor. The laminated inductor described in JP-A-2002-260925 will now be described with reference to FIG. 5, which is a schematic view of the internal structure of the laminated inductor.

A laminated inductor 101 includes a laminate 102 and a coil 103 formed inside the laminate. The coil 103 includes non-magnetic insulating layers and conductive patterns alternately laminated, and the conductive patterns are connected to each other one after another so that the coil is wound in a stacking direction along which the insulating layers are stacked. External electrodes 106 and 107 are formed on the bottom surface of the laminate 102 in the vicinity of the pair of short sides. Each end of the coil 103 is connected to the corresponding, or respective external electrode 106 or 107 on the bottom surface of the laminate 102 by lead conductors 104 and 105. These lead conductors 104 and 105 are embedded in the side surfaces adjacent to the short sides, and the surfaces of the conductors are exposed to the outside.

A laminated inductor having the above-described structure disadvantageously has a small area for the coiled electrode, poor efficiency of obtaining inductance, and poor DC-superposed characteristics since the lead conductors 104 and 105 are formed outside the coil 103. Moreover, such a laminated inductor is unreliable because the ends of the internal electrode are exposed to the outside.

SUMMARY

Embodiments in accordance with the invention generally relate to a laminated inductor including a coil formed of coiled electrodes each coiled up in one turn and a lead via conductor formed inside an area located inside a path along the periphery of a laminate in which the coil is formed and surrounded by end portions of the coiled electrodes.

According to an embodiment, a laminated inductor includes a laminate having a plurality of insulating layers provided in a stacked arrangement and a helical coil including coiled electrodes. Each of the coiled electrodes is coiled up in one turn on a corresponding one of the insulating layers on a path along the periphery thereof and having a first end located on the path and a second end located outside the path.

A first via conductor connects predetermined first ends of the coiled electrodes adjacent to each other in a stacking direction along which the insulating layers are stacked, and a second via conductor connecting predetermined second ends of the coiled electrodes adjacent to each other in the stacking direction.

A first external electrode and a second external electrode are formed on the bottom surface of the laminate and are electrically connected to respective ends of the helical coil.

An area is enclosed by parts of the plurality of coiled electrodes including the first ends and the second ends when viewed in plan in the stacking direction of the laminate, and a lead via conductor extends to the inside of the area from the second end of one of the coiled electrodes furthest away from the external first and second electrodes. The lead via connects the end of the coiled electrode to the first external electrode.

Other features, elements, characteristics and advantages of the present invention will become more apparent from the following detailed description of a preferred embodiment of the present invention with reference to the attached drawings.

DETAILED DESCRIPTION

A laminated inductor according to an embodiment of the present invention will now be described with reference to FIGS. 1 to 4.

Figure 1:
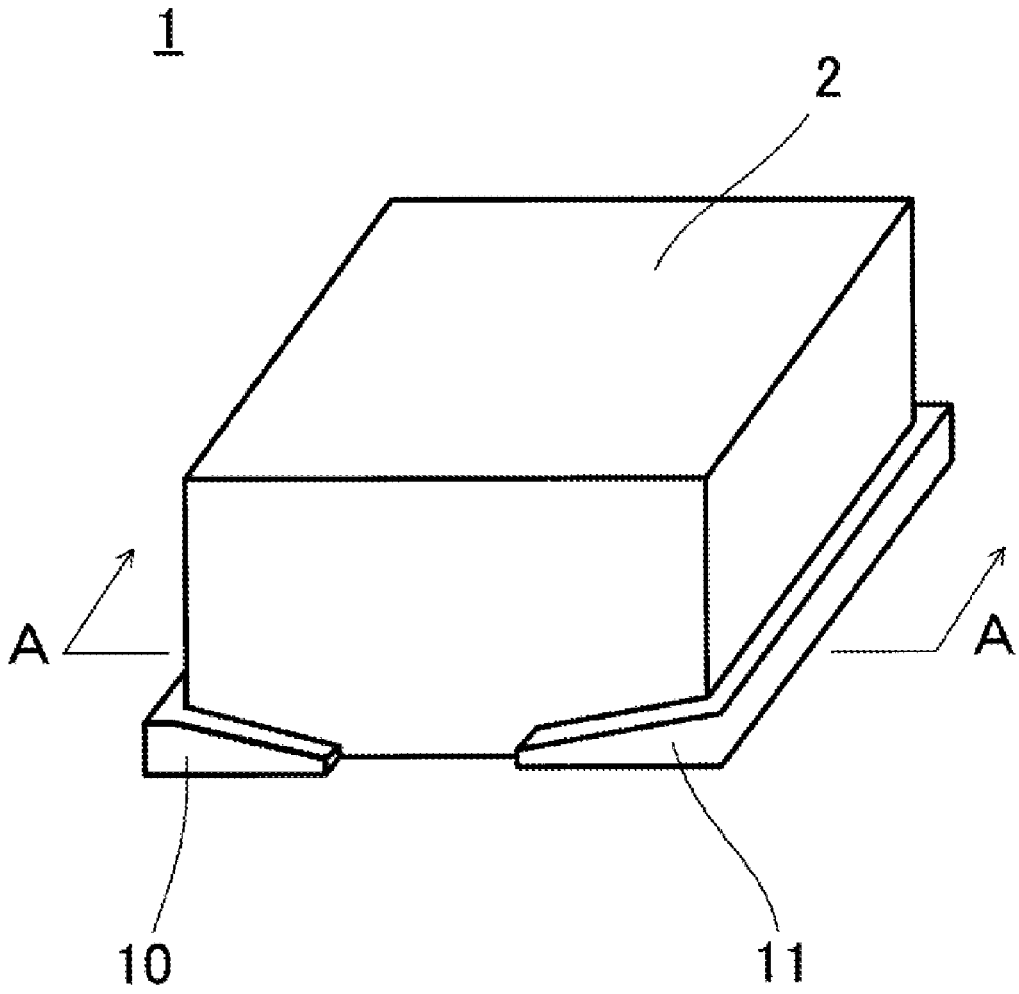
FIG. 1 is a schematic external view of a laminated inductor according to an exemplary embodiment.

As shown in FIG. 1, a laminated inductor 1 includes a rectangular parallelepiped laminate 2 having a helical coil within the laminate 2 and two external electrodes 10 and 11 formed on the bottom surface of the laminate 2.

Figure 2:
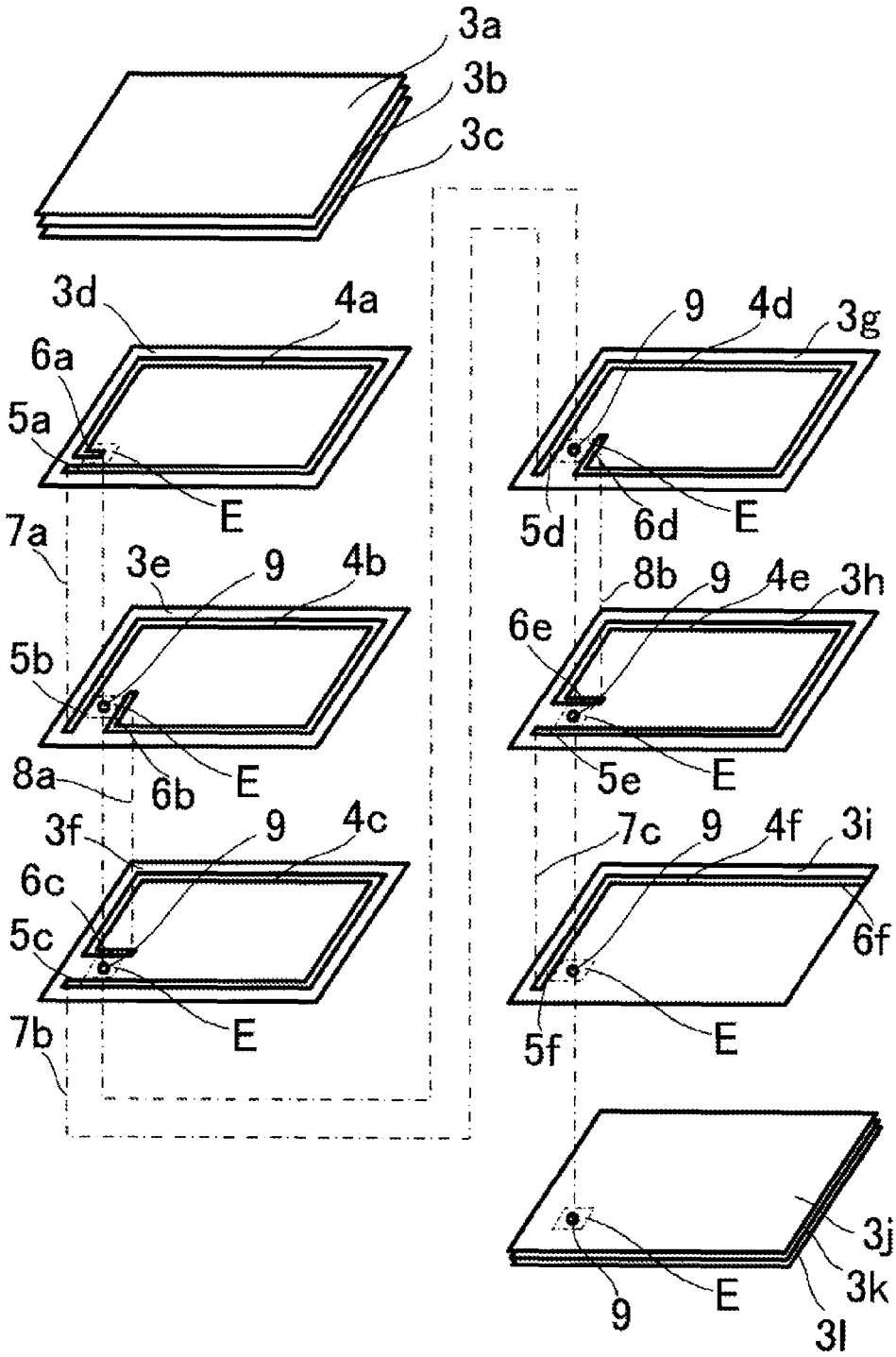
FIG. 2 is an exploded perspective view of a laminate of the laminated inductor shown in FIG. 1.

As shown in FIG. 2, the laminate 2 includes magnetic layers 3*a* to 3*l* and coiled electrodes 4*a* to 4*f*. The magnetic layers 3*a* to 3*l* are rectangular insulating layers composed of magnetic ferrite (Ni—Cu—Zn ferrite or Ni—Zn ferrite, for example). The coiled electrodes are formed on the magnetic layers 3*d* to 3*i* by printing using Ag paste.

Hereinafter, the magnetic layers 3*a* to 3*l*, the coiled electrodes 4*a* to 4*f*, and first ends 5*a* to 5*f* and second ends 6*a* to 6*f* of the coiled electrodes are individually referred to by the reference numbers with the alphabet characters, and are generally referred to by the same reference numbers without the alphabet characters.

The coiled electrodes 4*a* to 4*f* are electrically connected to each other by via conductors (described below) in the laminate 2 so as to form the helical coil. The coiled electrodes 4*b* to 4*e* on the magnetic layers 3*e* to 3*h*, respectively, among the coiled electrodes 4 are coiled up in one turn when viewed in plan in a stacking direction of the laminate 2 along which the magnetic layers 3*a* to 3*l* are stacked.

More specifically, the coiled electrodes 4*b* to 4*e* can be coiled up in rectangular, or substantially rectangular paths along the peripheries, and have the ends 5 located on the paths and the ends 6 extending outside the paths (inside the paths). The coiled electrodes 4*b* and 4*d* can have the ends 6 formed by extending ends of the electrode parts that lie along the long sides of the magnetic layers 3*e* and 3*g*, respectively, to the inside. Moreover, the coiled electrodes 4*c* and 4*e* can have the ends 6 formed by extending ends of the electrode parts that lie along the short sides of the magnetic layers 3*f* and 3*h*, respectively, to the inside. The coiled electrodes 4*b* and 4*d* can have the same shape, and the coiled electrodes 4*c* and 4*e* can have the same shape. That is, two kinds of the coiled electrodes 4*b* to 4*e* can be alternately disposed in the stacking direction.

Figure 3:
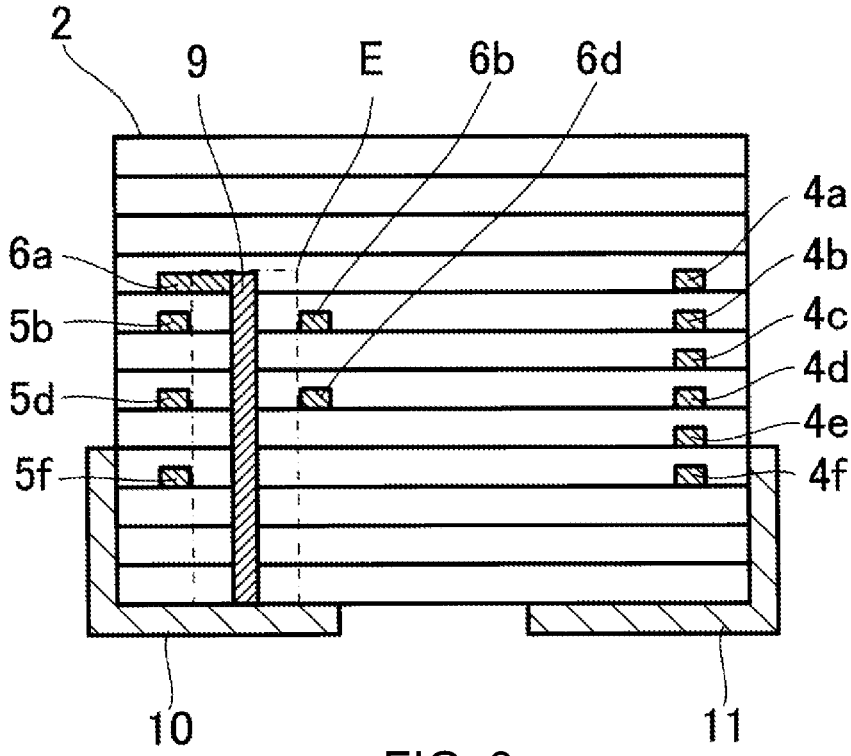
FIG. 3 is a cross-sectional view of the laminated inductor shown in FIG. 1 taken along line III-III.
Figure 4:
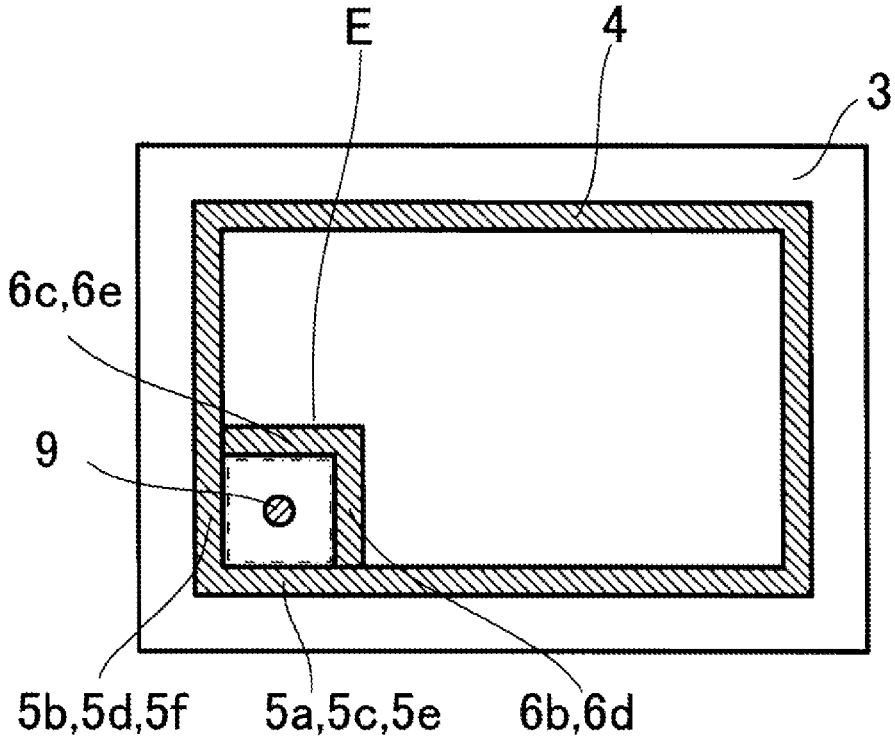
FIG. 4 is a plan view of the laminated inductor shown in FIG. 1 when viewed in a stacking direction along which the insulating layers are stacked.
Figure 5:
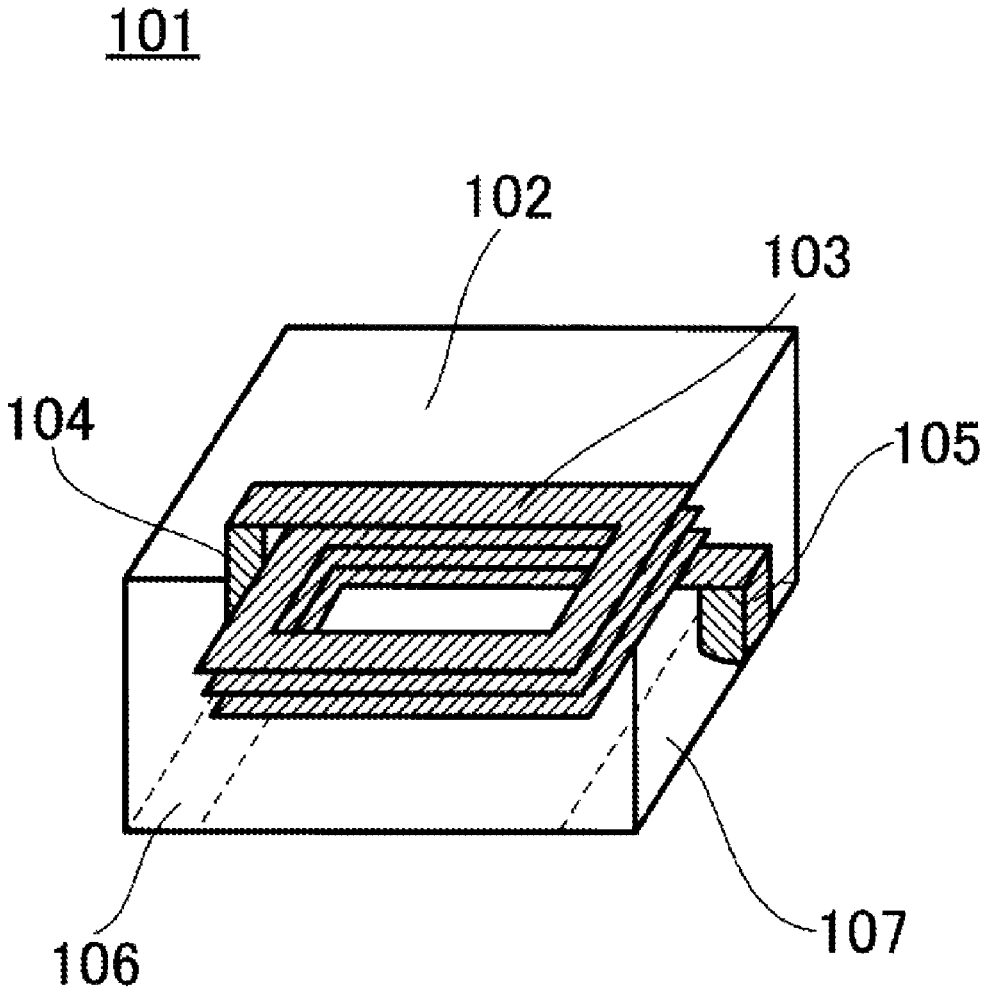
Fig. 5 Prior Art
FIG. 5 is a schematic cutaway view illustrating the internal structure of a known laminated inductor.

An area E shown in FIGS. 2, 3, and 4 can be enclosed by parts including the ends 5 of the coiled electrodes 4*a* to 4*f* and the ends 6*b* to 6*e* of the coiled electrodes 4*b* to 4*e* in the magnetic layers 3*d* to 3*l* when viewed in plan in the stacking direction.

Since the directions of the currents passing through the first ends 5 and the second ends 6 of the coiled electrodes 4 are the same in the magnetic layers 3, the direction of the magnetic flux produced by the current passing through the first ends 5 and that of the magnetic flux produced by the current passing through the second ends 6 are opposite to each other inside the area E. As a result, the magnetic fluxes do not pass through the area E.

Moreover, the coiled electrode 4*a* is further away from the external electrodes 10 and 11 than the coiled electrodes 4*b* to 4*f*, and the end 5*a* thereof is electrically connected to the coiled electrode 4*b*. The coiled electrode 4*a* is coiled up in one turn on the magnetic layer 3*d* when viewed in plan in the stacking direction. As shown in FIG. 2, the end 6*a* of the coiled electrode 4*a* is extended to the inside of the area E when the magnetic layer 3*d* is viewed in plan in the stacking direction of the laminate 2, and is connected to the external electrode 10 formed on the bottom surface of the laminate 2 by a lead via conductor 9 (described below).

Moreover, the coiled electrode 4*f* is closer to the external electrodes 10 and 11 than the coiled electrodes 4*a* to 4*e*, and the end 5*f* thereof is electrically connected to the coiled electrode 4*e*. The coiled electrode 4*f* on the magnetic layer 3*i* is coiled up in a half turn when viewed in plan in the stacking direction. As shown in FIG. 2, the end 6*f* of the coiled electrode 4*f* extends to, and terminates at a short side of the magnetic layer 3*i*. With this, the coiled electrode 4*f* is connected to the external electrode 11 by the end 6*f* thereof extending to a side surface of the laminate 2.

As shown in FIGS. 3 (the magnetic insulator layers 3 are not hatched) and 4, the lead via conductor 9 extends from the end 6*a* of the coiled electrode 4*a* to the inside of the area E (downward in FIG. 3) so as to be connected to the external electrode 10 formed on the bottom surface of the laminate 2.

More specifically, holes can be formed in each of the magnetic layers 3*d* to 3*l* inside the area E and filled with Ag paste so that vias are formed in each layer. The lead via conductor 9 can be formed by laminating the magnetic layers 3*d* to 3*l* one after another such that the vias in each layer are connected. In this way, the lead via conductor 9 extending from the end 6*a* of the coiled electrode 4*a* can be connected to the external electrode 10 formed on the bottom surface of the laminate 2.

The coiled electrodes 4*a* to 4*f* are electrically connected to each other by via conductors 7 and 8 to form a helical coil. More specifically, a first via conductor 7*a* can be formed by filling a hole in the magnetic layer 3*d* with Ag paste at the same time when the coiled electrode 4*a* is printed. This first via conductor 7*a* connects the ends 5*a* and 5*b* that are adjacent to each other in the stacking direction of the laminate 2.

First via conductors 7*b* and 7*c* and second via conductors 8*a* and 8*b* are formed in a manner similar to the first via conductor 7*a*. The first via conductors 7 connecting the ends 5 on the paths along the peripheries and the second via conductors 8 connecting the ends 6*b* to 6*e* outside the paths along the peripheries are alternately disposed in the stacking direction. With this, the plurality of coiled electrodes 4 are continuously connected to each other in an uninterrupted manner.

Although the second external electrode 11 is connected to the coiled electrode 4*f* via the side surface of the laminate 2 in the above-described embodiment, the connection can be achieved using a via conductor formed inside the laminate 2 in the present invention. This structure can provide a highly reliable laminated inductor since no internal electrodes are exposed to the outside.

Embodiments consistent with the claimed invention can facilitate achieving excellent efficiency in obtaining inductance value and DC-superposed characteristics. More specifically, because a lead via can be provided in an area through which magnetic fluxes do not pass, a large or increased area for the coiled electrodes can be obtained even when the laminated inductor has the external electrodes on the bottom surface of the laminate.

As a result, the efficiency of obtaining inductance can be improved. Moreover, magnetic fluxes are not easily saturated due to the large area for the coiled electrodes. As a result, the DC-superposed characteristics can be improved.

While a preferred embodiment of the invention has been described above, it is to be understood that variations and modifications will be apparent to those skilled in the art without departing from the scope and spirit of the invention. The scope of the invention, therefore, is to be determined solely by the following claims and their equivalents.

What is claimed is:

1. A laminated inductor comprising:

a laminate including a plurality of insulating layers;

a helical coil including coiled electrodes, each said coiled electrode coiled up in one turn on a corresponding one of the insulating layers on a path along a periphery thereof and having a first end located on the path and a second end located outside the path, a first via conductor connecting predetermined first ends adjacent to each other in a stacking direction along which the insulating layers are stacked, and a second via conductor connecting predetermined second ends adjacent to each other in the stacking direction;

a first external electrode and a second external electrode formed on a bottom surface of the laminate and electrically connected to respective ends of the helical coil;

an area enclosed by parts including the first ends and the second ends of the plurality of coiled electrodes when viewed in plan in the stacking direction of the laminate; and a lead via conductor extending to the inside of the area from the second end of one of the coiled electrodes farthest from the first and second external electrodes, said lead via connecting the end of the coiled electrode to the first external electrode.

2. The laminated inductor of claim 1, wherein the path has a substantially rectangular shape.

3. The laminated inductor of claim 1, wherein the second external electrode connects to a terminating end of one of the coiled electrodes closest to the first and second external electrodes, said terminating end extending to a side surface the laminate.

4. The laminated inductor of claim 1, wherein with a current passing through the helical coil, the direction of magnetic flux produced by the current passing through the first ends and the direction of magnetic flux produced by the current passing through the second ends are opposite to each other.

* * * * *